US011232745B2

(12) United States Patent
Holsteen et al.

(10) Patent No.: US 11,232,745 B2
(45) **Date of Patent: *Jan. 25, 2022**

(54) MULTI-FRAME BUFFER FOR PIXEL DRIVE COMPENSATION

(71) Applicant: Apple Inc., Cupertino, CA (US)

(72) Inventors: Aaron L. Holsteen, Stanford, CA (US); Xiaokai Li, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/852,323

(22) Filed: Apr. 17, 2020

(65) Prior Publication Data

US 2020/0388204 A1 Dec. 10, 2020

Related U.S. Application Data

(60) Provisional application No. 62/858,805, filed on Jun. 7, 2019.

(51) Int. Cl.

| | |
|---|---|
| ***G09G 3/3225*** | (2016.01) |
| ***G09G 3/3258*** | (2016.01) |
| ***G09G 3/36*** | (2006.01) |
| ***G09G 3/20*** | (2006.01) |

(52) U.S. Cl.

CPC ..... *G09G 3/3225* (2013.01); *G09G 3/20* (2013.01); *G09G 3/3258* (2013.01); *G09G 3/3607* (2013.01); *G09G 2310/027* (2013.01); *G09G 2320/0242* (2013.01); *G09G 2320/0252* (2013.01); *G09G 2320/0257* (2013.01); *G09G 2320/041* (2013.01); *G09G 2320/0666* (2013.01); *G09G 2360/18* (2013.01)

(58) Field of Classification Search

CPC ..... G09G 3/3225; G09G 3/20; G09G 3/3258; G09G 3/3607; G09G 2310/027; G09G 2320/0242; G09G 2320/0252; G09G 2320/0257; G09G 2320/041; G09G 2320/0666; G09G 2360/18

See application file for complete search history.

(56) References Cited

U.S. PATENT DOCUMENTS

| | | | |
|---|---|---|---|
| 6,426,735 | B1 | 7/2002 | Henzen |
| 9,165,503 | B2 | 10/2015 | Shih et al. |
| 9,805,661 | B2 | 10/2017 | Sun et al. |
| 10,026,358 | B2 | 7/2018 | He et al. |
| 10,304,381 | B2 | 5/2019 | Han |
| 10,347,184 | B2 | 7/2019 | Han et al. |
| 10,360,849 | B2 | 7/2019 | Cai |

(Continued)

OTHER PUBLICATIONS

First Action Interview Pilot Program Pre-Interview Communication issued in U.S. Appl. No. 16/852,331, dated Feb. 3, 2021 in 5 pages.

(Continued)

*Primary Examiner* — Xin Sheng

(74) *Attorney, Agent, or Firm* — Kilpatrick Townsend & Stockton LLP

(57) ABSTRACT

A flat-panel display device and method to unify response times for all possible grey level transitions in a flat-panel display or an augmented reality display. A pixel drive compensator compares the current frame from a graphics processing unit and two previous frames to compensate for grey-level changes at a pixel level.

20 Claims, 8 Drawing Sheets

(56) References Cited

U.S. PATENT DOCUMENTS

| | | | | |
|---|---|---|---|---|
| 10,515,590 | B2 | 12/2019 | Yuan et al. | |
| 10,573,266 | B2 | 2/2020 | Tseng et al. | |
| 10,714,036 | B2 | 7/2020 | Watanabe | |
| 2003/0137521 | A1 | 7/2003 | Zehner et al. | |
| 2003/0151599 | A1* | 8/2003 | Bone | G09G 3/3648 345/204 |
| 2006/0209095 | A1* | 9/2006 | Hsu | G09G 3/3611 345/690 |
| 2007/0052640 | A1* | 3/2007 | Feldman | G09G 3/3648 345/88 |
| 2008/0068318 | A1* | 3/2008 | Kerwin | G09G 3/3611 345/89 |
| 2010/0091039 | A1 | 4/2010 | Marcu et al. | |
| 2011/0063330 | A1* | 3/2011 | Bae | G09G 3/3611 345/690 |
| 2015/0070337 | A1 | 3/2015 | Bell et al. | |
| 2016/0155384 | A1 | 6/2016 | Kim et al. | |
| 2017/0004765 | A1 | 1/2017 | Tani et al. | |
| 2018/0204525 | A1 | 7/2018 | Comps et al. | |
| 2018/0293945 | A1 | 10/2018 | Wang | |
| 2018/0357960 | A1 | 12/2018 | Yang et al. | |
| 2019/0066608 | A1 | 2/2019 | Watanabe | |
| 2019/0156753 | A1 | 5/2019 | Yang et al. | |
| 2019/0213949 | A1 | 7/2019 | Han | |
| 2019/0318684 | A1 | 10/2019 | Gai et al. | |
| 2019/0371245 | A1 | 12/2019 | Yuan et al. | |
| 2019/0371258 | A1 | 12/2019 | Morein | |
| 2019/0392777 | A1 | 12/2019 | Kim et al. | |
| 2020/0302883 | A1 | 9/2020 | Watanabe | |
| 2020/0388204 | A1 | 12/2020 | Holsteen et al. | |
| 2020/0388213 | A1 | 12/2020 | Holsteen et al. | |
| 2020/0388224 | A1 | 12/2020 | Holsteen et al. | |
| 2020/0388233 | A1 | 12/2020 | Holsteen et al. | |

OTHER PUBLICATIONS

First Action Interview Pilot Program Pre-Interview Communication issued in U.S. Appl. No. 16/852,317, dated Apr. 30, 2021 in 5 pages.

Non-Final Office Action issued in U.S. Appl. No. 16/852,339, dated May 5, 2021 in 22 pages.

First Action Interview Office Action Summary issued in U.S. Appl. No. 16/852,331, dated May 20, 2021 in 5 pages.

First Action Interview Office Action Summary issued in U.S. Appl. No. 16/852,317, dated Aug. 6, 2021 in 4 pages.

Final Office Action issued in U.S. Appl. No. 16/852,339 dated Nov. 12, 2021 in 26 pages.

* cited by examiner

PDC LUT

| Sum of $x_1$ | Sum of $x_2$ | 0 | 32 | 64 | 96 | 128 | 160 | 192 | 224 | 255 |
|---|---|---|---|---|---|---|---|---|---|---|
| 0 | 0 | 0 | 32 | 64 | 96 | 128 | 160 | 192 | 224 | 255 |
| 32 | 32 | 0 | 32 | 64 | 96 | 128 | 160 | 192 | 224 | 255 |
| 64 | 64 | 0 | 32 | 64 | 96 | 128 | 160 | 192 | 224 | 255 |
| 96 | 96 | 0 | 32 | 64 | 96 | 128 | 160 | 192 | 224 | 255 |
| 128 | 128 | 0 | 32 | 64 | 96 | 128 | 160 | 192 | 224 | 255 |
| 160 | 160 | 0 | 32 | 64 | 96 | 128 | 160 | 192 | 224 | 255 |
| 192 | 192 | 0 | 32 | 64 | 96 | 128 | 160 | 192 | 224 | 255 |
| 224 | 224 | 0 | 32 | 64 | 96 | 128 | 160 | 192 | 224 | 255 |
| 255 | 255 | 0 | 32 | 64 | 96 | 128 | 160 | 192 | 224 | 255 |

FIG. 5A

PM LUT

| Sum of $x_1$ | Sum of $x_2$ | 0 | 32 | 64 | 96 | 128 | 160 | 192 | 224 | 255 |
|---|---|---|---|---|---|---|---|---|---|---|
| 0 | 0 | 0 | 32 | 64 | 96 | 128 | 160 | 192 | 224 | 255 |
| 32 | 32 | 32 | 32 | 64 | 96 | 128 | 160 | 192 | 224 | 255 |
| 64 | 64 | 64 | 64 | 64 | 96 | 128 | 160 | 192 | 224 | 255 |
| 96 | 96 | 96 | 96 | 96 | 96 | 128 | 160 | 192 | 224 | 255 |
| 128 | 128 | 128 | 128 | 128 | 128 | 128 | 160 | 192 | 224 | 255 |
| 160 | 160 | 160 | 160 | 160 | 160 | 160 | 160 | 192 | 224 | 255 |
| 192 | 192 | 192 | 192 | 192 | 192 | 192 | 192 | 192 | 224 | 255 |
| 224 | 224 | 224 | 224 | 224 | 224 | 224 | 224 | 224 | 224 | 255 |
| 255 | 255 | 255 | 255 | 255 | 255 | 255 | 255 | 255 | 255 | 255 |

FIG. 5B

D27 White Point (PDC Disabled)

| Frame | 1 | 2 | 3 | 4 | 5 | 6 | ... | u' | v' |
|---|---|---|---|---|---|---|---|---|---|
| R (GL) | 255 | 255 | 255 | 255 | 255 | 255 | ... | | |
| G (GL) | 186 | 186 | 186 | 186 | 186 | 186 | ... | | |
| B (GL) | 94 | 94 | 94 | 94 | 94 | 94 | ... | | |
| Solid image | | | | | | | ... | 0.258 | 0.527 |

| Frame | 1 | 2 | 3 | 4 | 5 | 6 | ... | u' | v' |
|---|---|---|---|---|---|---|---|---|---|
| R (GL) | 0 | 255 | 255 | 0 | 255 | 255 | ... | | |
| G (GL) | 0 | 186 | 186 | 0 | 186 | 186 | ... | | |
| B (GL) | 0 | 94 | 94 | 0 | 94 | 94 | ... | | |
| Solid image | | | | | | | ... | 0.273 | 0.529 |

| duv' |
|---|
| 0.0148 |

FIG. 7A (PDC Enabled)

| Frame | 1 | 2 | 3 | 4 | 5 | 6 | ... | u' | v' |
|---|---|---|---|---|---|---|---|---|---|
| R (GL) | 255 | 255 | 255 | 255 | 255 | 255 | ... | | |
| G (GL) | 186 | 186 | 186 | 186 | 186 | 186 | ... | | |
| B (GL) | 94 | 94 | 94 | 94 | 94 | 94 | ... | | |
| Solid image | | | | | | | ... | 0.256 | 0.527 |

| Frame | 1 | 2 | 3 | 4 | 5 | 6 | ... | u' | v' |
|---|---|---|---|---|---|---|---|---|---|
| R (GL) | 0 | 255 | 255 | 0 | 255 | 255 | ... | | |
| G (GL) | 0 | 208 | 186 | 0 | 208 | 186 | ... | | |
| B (GL) | 0 | 119 | 94 | 0 | 119 | 94 | ... | | |
| Solid image | | | | | | | ... | 0.261 | 0.528 |

| duv' |
|---|
| 0.004 |

FIG. 7B

| White Point | sRGB 8 bits | | |
|---|---|---|---|
| | R | G | B |
| 11500K | 188 | 213 | 255 |
| 7500K | 235 | 243 | 255 |
| 6500K | 255 | 255 | 255 |
| 6000K | 255 | 250 | 241 |
| 5100K | 255 | 237 | 211 |
| 4500K | 255 | 225 | 185 |
| 3500K | 255 | 198 | 131 |
| 2700K | 255 | 186 | 94 |

FIG. 8

MULTI-FRAME BUFFER FOR PIXEL DRIVE COMPENSATION

CROSS-REFERENCES TO RELATED APPLICATIONS

This application claims priority to U.S. Provisional Patent Application Ser. No. 62/858,805, filed Jun. 7, 2019, entitled "Two Dimensional Temperature Compensation For Pixel Drive Compensation," which is herein incorporated by reference in its entirety and for all purposes.

BACKGROUND

Field

Aspects of the disclosure relate in general to displays. Aspects include a method and device unify response times for all possible grey-level transitions in a flat-panel display or an augmented reality display. A pixel drive compensator compares the current frame from a graphics processing unit and two previous to compensate for grey-level changes at a pixel level.

Description of the Related Art

Displays are electronic viewing technologies used to enable people to see content, such as still images, moving images, text, or other visual material.

A flat-panel display includes a display panel including a plurality of pixels arranged in a matrix format. The display panel includes a plurality of scan lines formed in a row direction (y-axis) and a plurality of data lines formed in a column direction (x-axis). The plurality of scan lines and the plurality of data lines are arranged to cross each other. Each pixel is driven by a scan signal and a data signal supplied from its corresponding scan line and data line.

Flat-panel displays can be classified as passive matrix type light emitting display devices or active matrix type light emitting display devices. Active matrix panels selectively light every unit pixel. Active matrix panels are used due to their resolution, contrast, and operation speed characteristics.

One type of active matrix display is an active matrix organic light emitting diode (AMOLED) display. The active matrix organic light emitting display produces an image by causing a current to flow to an organic light emitting diode to produce light. The organic light emitting diode is a light-emitting element in a pixel. The driving thin film transistor (TFT) of each pixel causes a current to flow in accordance with the gradation of image data.

Flat-panel displays are used in many portable devices such as laptops and mobile phones.

Moving images, such as those in scrolling text, results in pixels transitioning between white, black, or grey states. The time when pixels are transitioning between white/black or grey levels is called the "rise time" and "fall time" or collectively, "response time" of the pixel transition. When response time is slow, the transition from an image frame to another can produce an after image or blurring effect. The blurring is sometimes referred to as the "jelly" or "jello" effect. This problem occurs not only when looking at motion pictures, but also during scrolling text.

SUMMARY

Embodiments include an electronic display designed to unify response times for all possible grey-level transitions in a flat-panel display or an augmented reality display.

In one embodiment, an apparatus comprises a display panel and a pixel drive compensator. The display panel has a plurality of temperature sensors embedded throughout the display panel. The display panel is configured to generate a two-dimensional temperature map of the display panel. A pixel drive compensator is configured to receive a received image frame and output a compensated output frame to the display panel. The received image frame is comprised of a plurality of pixels. The pixel drive compensator further comprises a memory and an interpolator. The memory is configured to store a plurality of temperature compensated look up tables. The temperature compensated look up tables contains grey-to-grey overdrive values for a given temperatures T1 and T2. An interpolator is configured to retrieve a temperature (T) associated with a pixel from the received image frame based on the two-dimensional temperature map, where T1<T<T2. The interpolator is further configured to interpolate an overdrive value for the associated pixel using the temperature compensated lookup tables, and to generate the compensated output frame using the overdrive value for the associated pixel. The display panel is further configured to display the compensated output frame.

In another embodiment, an apparatus comprises a display panel and a pixel drive compensator. The display panel has a temperature sensor embedded in the display panel. The pixel drive compensator is configured to receive a received image frame and output a compensated output frame to the display panel. The received image frame is comprised of a plurality of pixels. The pixel drive compensator further comprises a memory, a previous frame buffer, a second previous frame buffer, a duration mask, and an interpolator. The memory is configured to store a thin compensated look up table and a thick compensated look up table. The thin and the thick compensated look up tables contains grey-to-grey overdrive values for a given temperatures T1 and T2. The previous frame buffer is configured to store a previous frame. The second previous frame buffer is configured to store a second previous frame. The duration mask is configured to compare a given pixel from the received image frame, the previous frame, and the second previous frame to determine whether the thin compensation table or the thick compensated table should be used. The interpolator is configured to retrieve a temperature (T) associated the display panel, where T1<T<T2, to interpolate an overdrive value for a pixel from the image frame using the compensated lookup tables determined by the duration mask. The interpolator generates the compensated output frame using the overdrive value for the associated pixel. The display panel is further configured to display the compensated output frame.

In another embodiment, an apparatus comprises a display panel and a pixel drive compensator. The display panel has a temperature sensor embedded in the display panel. The pixel drive compensator is configured to receive a received image frame and output a compensated output frame to the display panel. The received image frame is comprised of a plurality of pixels. The pixel drive compensator further comprises a memory, a previous frame buffer, and an interpolator. The memory configured to store a thin compensated look up table and a thick compensated look up table. The thin and the thick compensated look up tables contains grey-to-grey overdrive values for a given temperatures T1 and T2. The previous frame buffer configured to store a previous frame. The interpolator is configured to retrieve a temperature (T) associated with the display panel, where T1<T<T2. The interpolator determines an overdrive value for a pixel from the image frame and a corresponding pixel from the previous image frame using the compensated lookup tables. The interpolator generates the compensated output frame using the overdrive value for the pixel. The display panel is further configured to display the compensated output frame. The previous frame buffer is further configured to store the compensated output frame.

BRIEF DESCRIPTION OF THE DRAWINGS

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

FIG. 5A illustrates an example pixel drive compensation lookup table.

FIG. 5B illustrates an example pixel drive compensation lookup table.

FIGS. 7A and 7B illustrate example sequential measurement of D27 solid patterns when pixel drive compensation is disabled and enabled.

FIG. 8 shows typical red green blue (RGB) values for various white points.

DETAILED DESCRIPTION

Figure 1:
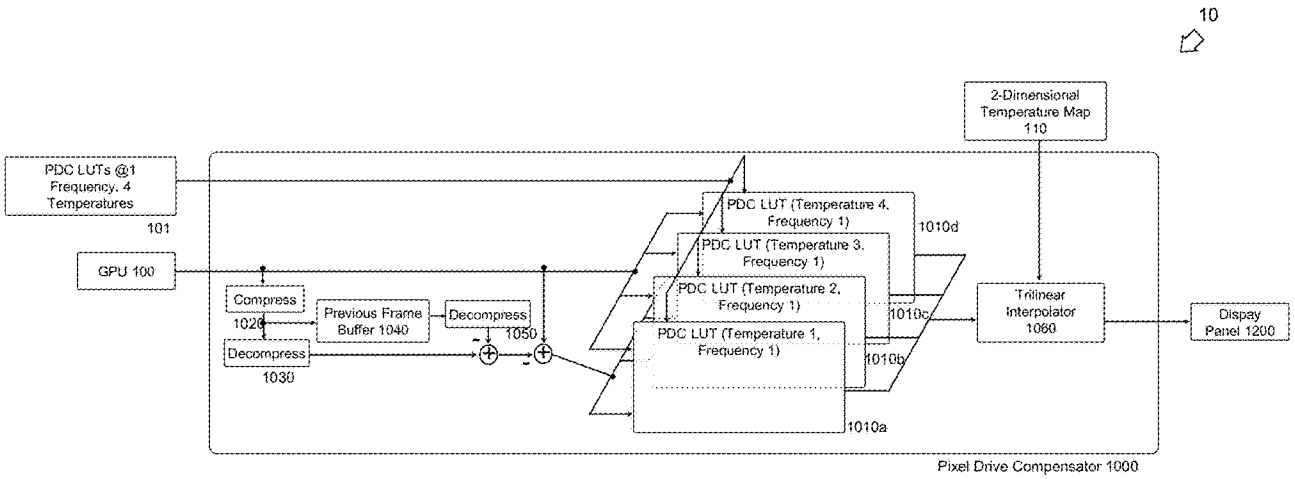
FIG. 1 is a block diagram of a display system with a pixel drive compensator that compensates for temperature variation across a display panel in two-dimensions.

One aspect of the disclosure is the realization that pixels transitioning between white, black, or grey states in a display panel do so at different response times because of temperature variations across the display panel. While the overall temperature of a display panel affects the grey-level response times, another aspect of the disclosure is the discovery that temperature variation across a display panel plays an even greater influence on the grey-level response time. Color breakup performance is improved at locations of cooler temperatures when compared to warmer temperatures. Therefore, in some embodiments of the disclosure, local temperature of a pixel region may be accounted for calculating the compensation for a transition response time.

In another aspect of the disclosure, different color balances of an initial state of the pixel has been discovered to affect the grey-level response time. Specifically, a greater shift in grey-level results in a longer response time. When the response time of the liquid crystal material is greater than the frame rate (which is a common case where the response time is approximately 12 ms and a 120 Hz frame is 8.3 ms), content sizes less than the motion scroll speed per frame (i.e. "thin" content) will require a different amount of pixel drive compensation. In such a case, the liquid crystal has not fully settled to its equilibrium configuration before being driven to a new equilibrium. The "front of screen" (FoS) impact of this limitation manifests itself by visible variations in the motion tail color, often with the thin content motion blur tails appearing more green than counterparts which have content sizes greater than the motion scroll speed per frame (i.e. "thick" content).

This blurring effect can easily be understood by looking at the temporal luminance curves for both cases. For content with sizes less than the motion scroll speed per frame, the optimized pixel drive compensation value for thick content case leads to a large amount of overshoot of pixel drive compensation even though the target grey-level is the same value. The thin content case needs a lesser amount of pixel drive compensation in order to go back to a bright white after only a single frame duration at a dark black. For similar motion content with a double or triple frame duration, different pixel drive compensation amounts are required, but to a lesser degree. One aspect of the disclosure is the discovery that the majority of front of screen artifacts correspond to the single frame difference case.

With a single frame buffer, the only way to mitigate this limitation is to choose a pixel drive compensation level for a single frame buffer that compromises between the thick and thin content. This prevents either content type from being fully optimized for the best front of screen experience.

Consequently, the solution to unifying response times for grey-level (GL) transitions should take in account the temperature variations across the display panel or recent-past grey-level states of the pixel in question.

This disclosure teaches the use of a Pixel Drive Compensator (PDC) to unify response times for grey-level transitions. A Pixel Drive Compensator receives an image frame from a graphics processing unit (GPU) and outputs a resulting image to a display panel. In some embodiments, the pixel drive compensator may be part of the graphics processing unit. It is further understood while embodiments will be disclosed in reference to a display panel that is a flat-panel display, alternate embodiments may include a panel display implemented for use in an augmented reality display. These embodiments are for explanatory purposes only and other embodiments may be employed in other display devices. For example, embodiments of the disclosure can be used with any display device that unifying response times for grey-level (GL) transitions in a pixel-driven display unit.

The pixel drive compensator unifies the response times for grey-level transitions by applying a higher or lower voltage for a single frame based off a look-up table (LUT) for any GL transition on a display panel. Without Pixel Drive Compensation, there is a large variation in the native response time of liquid crystal (LC) panels as well as the first frame luminance of an Organic Light Emitting Diode (OLED) panel. Unifying the response time for all grey-level transitions results in color balance in motion-tails and a reduction of motion blur tail length for mid-grey-level transitions. In low persistence mode (LPM) cases, a unified response time may result in color-balanced double-image artifacts as well as a reduction of double-tail visibility for mid-GL transitions.

Several pixel drive compensator embodiments are disclosed. The first embodiment pixel drive compensator accommodates and takes into account temperature variation across a display panel in two-dimensions. Two alternate embodiment pixel drive compensators take into account the previous grey-level state.

FIG. 1 is a block diagram of a display system 10 embodiment with a pixel drive compensator 1000 designed to unify the response times for all possible grey-level transitions by applying a higher or lower voltage for a single frame based off a look-up table for any grey-level transition on a display panel 1200 while taking account temperature variation across the display panel in two-dimensions, in accordance with an embodiment of the present disclosure.

In this embodiment, a display system 10 comprises a graphics processing unit 100, a pixel drive compensator 1000, a pixel drive compensator look-up-tables 101, and a display panel 1200.

Display system 10 may be a stand-alone display, or part of: a computer display, television set, notebook computer, tablet computer, mobile phone, smartphone, augmented reality display, digital "smart" watch, or other digital device. Pixel drive compensator 1000 is configured to receive an image frame from a graphics processing unit 100 and output a more unified response-time frame to display panel 1200.

Graphics processing unit 100 is a specialized electronic circuit designed to rapidly manipulate and alter memory to accelerate the creation of images in a frame buffer intended for output to a display panel 1200. In embodiments of the disclosure, the graphics processing unit 100 outputs images directly to the pixel drive compensator 1000. In some embodiments, pixel drive compensator 1000 may be part of graphics processing unit 100.

The display panel 1200 may be an organic light-emitting diode (OLED) display, such as a passive-matrix (PMOLED) or active-matrix (AMOLED). In other embodiments, the display panel 1200 may be a liquid crystal display (LCD) or micro-light emitting diode (micro-LED) display. The display panel 1200 displays an image received from a pixel drive compensator 1000. For local temperature compensation, every pixel in display panel 1200 has an associated temperature (sometimes referred to as the "local temperature" or "LT") which is stored in a 2-dimensional temperature map 110. The 2-dimensional temperature map 110 may be a static random access memory (SRAM) used to store the associated temperatures for the pixels of the display panel 1200 using frame height and width in pixels as the two dimensions. The associated temperatures are used to select an over-drive value for each frame from a pixel drive compensator look-up table 1010*a-d* for its grey-level transitions. In some display panel 1200 embodiments, a temperature sensor is embedded at each pixel. However, a temperature sensor at each pixel may not be practical for every display panel 1200. In alternate embodiments, each an associated temperature for each pixel can be estimated. Consequently, display panel 1200 may include a plurality of embedded temperature sensors throughout the display panel 1200, which allows for the creation of a two-dimensional temperature map 110. In some embodiments, the display panel 1200 generates the two-dimensional temperature map 110.

Pixel drive compensation lookup table 101 is an external compensation lookup table corresponding to each pixel greyscale in display panel 1200. The axis for the table is the starting grey-level and ending grey-levels. The cells of the table may comprise corresponding preset driving voltages to compensate the transition between the starting and ending grey-levels ("the overdrive values"). Such an embodiment is shown in FIG. 5A.

Pixel drive compensator 1000 may be implemented in hardware, as shown in FIG. 1, or as software or firmware stored in a non-transient computer-readable medium. A software or firmware embodiment may be executed by a microprocessor. As depicted in FIG. 1, a hardware embodiment of pixel drive compensator 1000 may comprise: a video compression unit 1020, a first video decompression unit 1030, a previous frame buffer 1040, and a second video decompression unit 1050, memory to store pixel drive compensation lookup tables 1010*a-d* based on temperature, and a trilinear interpolator 1060. These structures are described in greater detail below.

As described herein, pixel drive compensator 1000 uses the local temperature of a specific area of a display panel 1200, rather than the maximum panel temperature, sometimes referred to as "global temperature" (GT). The local temperature is received from the two-dimensional temperature map 110.

For a given frequency of the display panel 1200, a temperature pixel drive compensator look-up table 101 is loaded into static random access memory (SRAM, depicted as 1010) to be available to interpolate over a 10-50° C. temperature range that could be present on the panel. In some other embodiments, the temperature pixel drive compensator look-up table 101 is available to interpolate over a 0-60° C. temperature range. In some embodiments, as shown in FIG. 1, the look-up-table 1010 may be divided into a plurality of look-up-tables 1010*a-d*. The embodiment shown in FIG. 1 has four look-up-tables 1010, but other embodiments may have two, three, or more look-up-tables 1010.

In embodiments where exact pixel temperature is not known, a trilinear interpolator 1050 may be used for each pixel. Initially, pixel grey-to-grey transition is assumed to be at a temperature T, where T is known to be T1<T<T2. The trilinear interpolator 1050 performs a 2× bilinear interpolation using a look-up table for temperature T1 and a look-up table for temperature T2. Using the two look-up tables, over drive (OD) values for temperatures T1 and T2 are retrieved, and a 1× linear interpolation may be used to derive an over drive value at temperature T.

When applying the methodology taught herein, color breakup performance in display panel 1200 is improved especially at locations of cooler temperatures when the local temperature is used when compared to the maximum panel temperature.

Figure 2:
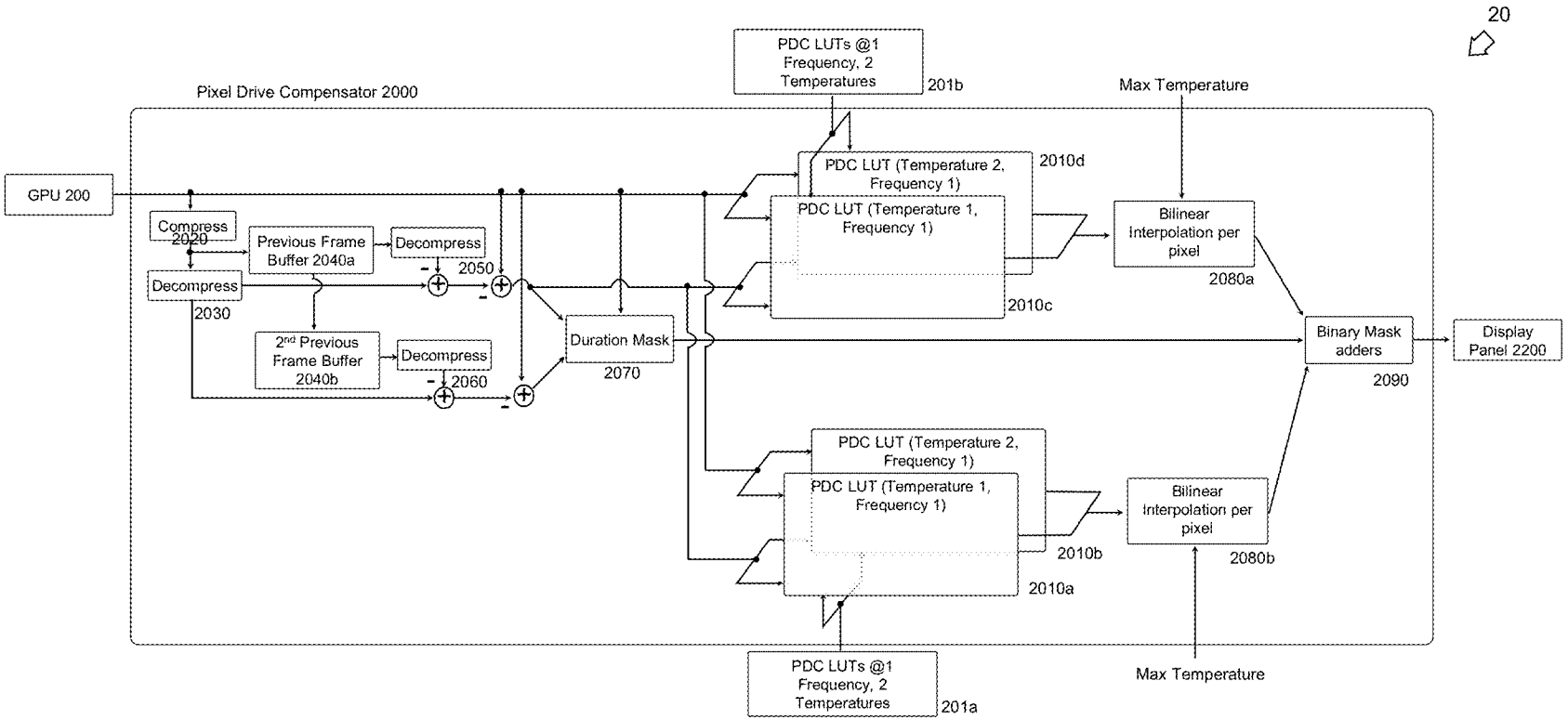
FIG. 2 depicts a block diagram of a display system with a pixel drive compensator with a multi-frame buffer.

We now turn to FIG. 2, which each depicts an alternate embodiment of a display system 20 with a pixel drive compensator 2000 with a multi-frame buffer (previous frame buffer 2040*a*, and 2$^{nd}$ previous frame buffer 2040*b*), in accordance with an embodiment of the present disclosure. Display system 20 compensates for the length of time a given pixel has been in a particular grey-level state. Specifically, previous frame buffer 2040*a*, and 2$^{nd}$ previous frame buffer 2040*b* provide the pixel drive compensator 2000 a memory for how long a pixel has been in a particular grey-level state.

Display system 20 comprises a graphics processing unit 200, a pixel drive compensator 2000, a pixel drive compensator look-up-tables 201*a-b*, and a display panel 2200.

As discussed above, display system 20 may be a stand-alone display, or part of: a computer display, television set, notebook computer, tablet computer, mobile phone, smartphone, augmented reality display, digital "smart" watch, or other digital device.

Graphics processing unit 200 is a specialized electronic circuit designed to rapidly manipulate and alter memory to accelerate the creation of images in a frame buffer intended for output to a display panel 2200. In embodiments of the disclosure, the graphics processing unit 200 outputs images directly to the pixel drive compensator 2000. In some embodiments, pixel drive compensator 2000 may be part of graphics processing unit 200.

Pixel drive compensator 2000 is configured to receive an image frame from a graphics processing unit 200 and output a more unified response-time frame to display panel 2200.

Display panel 2200 may be an organic light-emitting diode (OLED) display, liquid crystal display (LCD) micro-light emitting diode (micro-LED) display or other flat panel display known in the art. The display panel 2200 displays an image received from a pixel drive compensator 2000. Display panel 2200 includes a temperature sensor that records the maximum panel temperature, i.e. the "global temperature." As described herein, pixel drive compensator 2000 uses the maximum panel temperature received from a sensor in display panel 2200.

Figure 4:
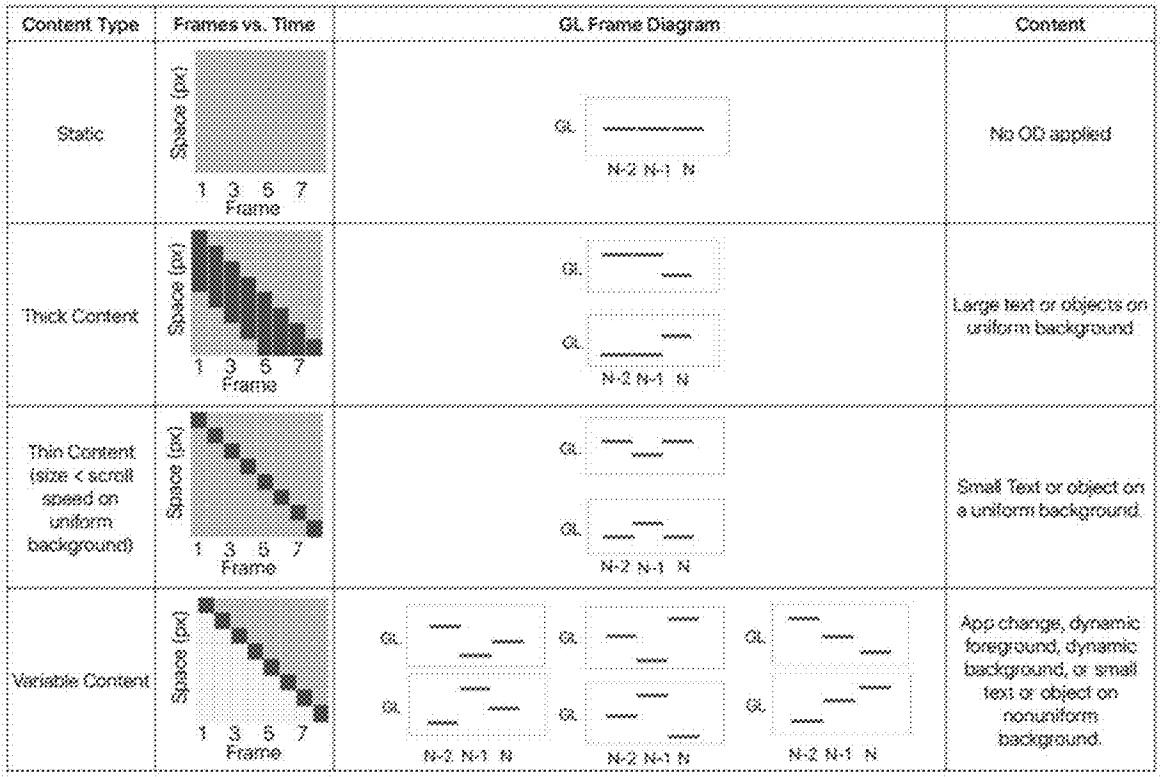
FIG. 4 depicts all distinguishable frame transactions for over drive with a two-frame buffer history.

Pixel drive compensation lookup tables 201*a-b* are external compensation lookup table corresponding to each pixel greyscale in display panel 1200. The axis for the table is the starting grey-level and ending grey-levels. In such an embodiment, pixel drive compensation lookup tables may be divided into a thin (or "weak") pixel drive compensation lookup table 201*a* and a thick (or "strong") pixel drive compensation lookup table 201*b*. The difference between the "strong" and "weak" lookup table depends targeted duration of the individual grey-level of the pixel. FIG. 4 shows for any three consecutive frames, any content of the same grey-level value that has a size less than the scroll speed on a uniform background (i.e. "thin content") requires a thin "weak" lookup table 201*a*. Conversely, any content that has a size greater than the scroll speed on a uniform background (i.e. "thick content") requires a "strong" lookup table 201*b*.

Pixel drive compensator 2000 may be implemented in hardware, as shown in FIG. 2, or as software or firmware stored in a non-transient computer-readable medium. A software or firmware embodiment may be executed by a microprocessor. As depicted in FIG. 2, a hardware embodiment of pixel drive compensator 2000 may comprise: a video compression unit 2020, a plurality of video decompression units (2030, 2050, 2060), a previous frame buffer 2040*a*, a second previous frame buffer 2040*b*, memory to store pixel drive compensation lookup tables 2010*a-d* based on temperature, duration mask 2070, two bilinear interpolators 2080*a-b*, and a binary mask adder 2090. The use of these structures is described below.

Unlike prior art limited with a single frame buffer, most "front of screen" artifacts with thick and thin content are resolved by introducing a second previous-frame buffer 2040*b* that keeps track of the second previous frame (Frame N-2) in addition to the first previous frame (Frame N-1) and the current frame (Frame N). Duration mask 2070 compares a given pixel for grey-level image transitions. All possible grey-level transitions monitored by a two-frame buffers is summarized in FIG. 4, in accordance with an embodiment of the present disclosure. As shown in FIG. 4, over drive may be applied to compensate for thick content. Using a two-frame buffers (2040*a-b*) to selectively locate regions of thin and thick content, the appropriate pixel drive compensation may be applied for each content type. The duration mask 2070 identifies the thin content region to selectively apply a reduced amount of pixel drive compensation as the region has not reached equilibrium prior to changing grey-levels. Conversely, thick content regions are any regions that changes between buffer N-1 and the current frame that excludes the thin content region.

For a given thickness of the content and frequency of the display panel 2200, a temperature pixel drive compensator look-up table 2010 is loaded into static random access memory (SRAM) to be available to interpolate over a 10-50° C. temperature range that could be present on the panel. In some other embodiments, the temperature pixel drive compensator look-up table 201 is available to interpolate over a larger temperature range depending on the operating temperature of the pixels, for example over a 0-60° C. temperature range.

The bilinear interpolators 2080*a-b* performs a 2× bilinear interpolation using a look-up table for temperature T1 and a look-up table for temperature T2. Using the two look-up tables, over drive (OD) values for temperatures T1 and T2 are retrieved, and a 1× linear interpolation may be used to derive an over drive value at temperature T.

Receiving input from duration mask 2070, binary mask adder 2090 selects the thick or thin drive information from the bilinear interpolators 2080*a* or 2080*b* for output to display panel 2200.

Figure 3:
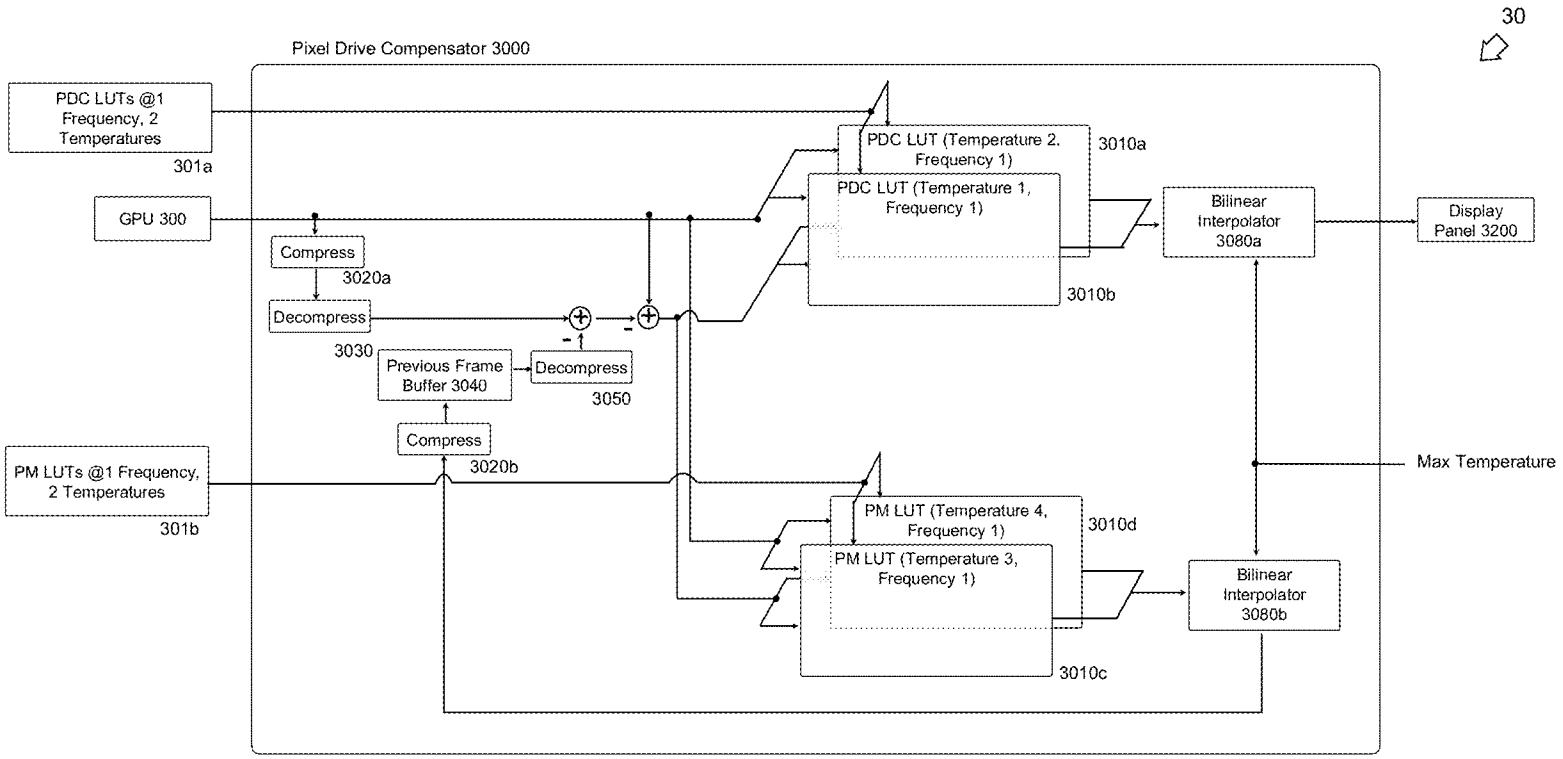
FIG. 3 illustrates a block diagram of a display system with a pixel drive compensator with a pixel modification write-back.

Turning to FIG. 3, FIG. 3 illustrates a block diagram of display system 30 with a pixel drive compensator 3000 with a pixel modification write-back, in accordance with an embodiment of the present disclosure. Display system 30 comprises a graphics processing unit 300, a pixel drive compensator 3000, a pixel drive compensator lookup tables 301*a-b*, and a display panel 3200.

As explained above, a single frame buffer gives no memory for how long a given pixel has been in a particular grey-level state. One way to circumvent the limitations presented by a single frame history, is to introduce a second pixel modification table 301*b* that modifies the end grey-level for any grey-level transition based on the current temperature and panel response time. Such a pixel modification table is shown in FIG. 5B. This modified value is then stored in a frame buffer that is used for pixel drive compensation.

Display system 30 may be a stand-alone display, or part of: a computer display, television set, notebook computer, tablet computer, mobile phone, smartphone, augmented reality display, digital "smart" watch, or other digital device.

Graphics processing unit 300 is a specialized electronic circuit designed to rapidly manipulate and alter memory to accelerate the creation of images in a frame buffer intended for output to a display panel 2200. In embodiments of the disclosure, the graphics processing unit 200 outputs images directly to the pixel drive compensator 2000. In some embodiments, pixel drive compensator 2000 may be part of graphics processing unit 200.

Pixel drive compensator 3000 is configured to receive an image frame from a graphics processing unit 300 and output a more unified response-time frame to display panel 3200.

Display panel 3200 may be an organic light-emitting diode (OLED) display, liquid crystal display (LCD) micro-light emitting diode (micro-LED) display or other flat panel display known in the art. The display panel 3200 displays an image received from a pixel drive compensator 3000. Display panel 3200 includes a temperature sensor that records the maximum panel temperature, i.e. the "global temperature." As described herein, pixel drive compensator 3000 uses the maximum panel temperature received from a sensor in display panel 3200.

Pixel drive compensation lookup tables 301*a-b* are external compensation lookup table corresponding to each pixel greyscale in display panel 3200. The axis for the table is the starting grey-level and ending grey-levels Pixel drive compensator 3000 may be implemented in hardware, as shown in FIG. 3, or as software or firmware stored in a non-transient computer-readable medium. A software or firmware embodiment may be executed by a microprocessor. As depicted in FIG. 3, a hardware embodiment of pixel drive compensator 3000 may comprise: video compression units 3020*a-b*, a plurality of video decompression units (3030, 3050), a previous frame buffer 3040, memory to store pixel drive compensation lookup tables 3010*a-d* based on temperature, and two bilinear interpolators 3080*a-b*. The use of these structures is described below.

Pixel drive compensator 3000 receives an image frame from graphics processing unit 300.

For a given frequency of the display panel 3200, a temperature pixel drive compensator look-up tables 301*a-b* are loaded into static random access memory (SRAM, depicted as 3010) to be available to interpolate over a temperature range that could be present on the panel. In some embodiments, as shown in FIG. 3, the lookup table 3010 may be divided into a plurality of lookup tables 3010*a-d*. For a given thickness of the content and frequency of the display panel 3200, a temperature pixel drive compensator look-up table 3010 is loaded into static random access memory (SRAM) to be available to interpolate over a 10-50° C. temperature range that could be present on the panel. In some other embodiments, the temperature pixel drive compensator look-up table 301 is available to interpolate over a larger temperature range depending on the operating temperature of the pixels, for example over a 0-60° C. temperature range.

The image frame received from graphics processing unit 300 is used along with a previous image frame stored in previous frame buffer 3040, which modifies the end grey-level for any grey-level transition based on the global temperature and panel response time.

Bilinear interpolator 3080*a-b* may be used for each pixel. Initially, pixel grey-to-grey transition is assumed to be at a temperature T, where T is known to be T1<T<T2. The bilinear interpolator 3080 performs a 2× bilinear interpolation using a look-up table for temperature T1 and a look-up table for temperature T2. Using the two look-up tables (3010*a-b* or 3010*c-d*), over drive (OD) values for temperatures T1 and T2 are retrieved, and a 1× linear interpolation may be used to derive an over drive value at temperature T.

This value is used to generate the voltage transition output for each pixel displayed to display panel 3200. The value then becomes the starting value for the next frame update.

Each pixel modification table 3010*a-d* has the same form as the pixel drive compensation lookup table 5000 embodiments shown in FIGS. 5A-5B. As shown in FIGS. 5A-5B, pixel drive compensation lookup table contains the indices of starting and ending grey-levels with the table entries being the effective ending grey-level for a selected temperature and panel frequency condition for three color channels. Hence, a 17×17×3 table can provide effective pixel modification write-back for any grey-level to another grey-level transition while applying effective pixel drive compensation. The only requirement on the size of the pixel drive compensation lookup table 5000 and pixel modification table 3010 is that they can be accurately bilinearly interpolated to recover the needed compensation at the specific start and end pixel grey levels. The tables need not be linearly spaced (i.e. grey-level tapping points [0 10 15 20 60 128 224 255] could work as well).

The pixel drive compensation display embodiments (10, 20, 30) described above compress and store a current or previous frame in a frame buffer in order to determine the amount of compensation for the frame. This process of storing frames can be power intensive for portable electronic devices when frames are high definition. Reading and writing from frame buffers (1040, 2040*a-b*, or 3040) is the primary cost of enabling pixel drive compensators (1000, 2000, 3000) in a display apparatus. The over voltages for the compensation has a negligible impact on system power. While some implementations may use lossy compression schemes and chroma resampling to reduce the size of the frame buffer, this has a negative impact on the "front of screen" performance and only moderately reduces the power footprint. In one aspect of the disclosure, pixel drive compensation is enabled when front of screen conditions provide the most noticeable improvement, and disabled when front of screen conditions provide negligible improvement. The resulting embodiments save power while still enabling pixel drive compensation.

Figure 6:
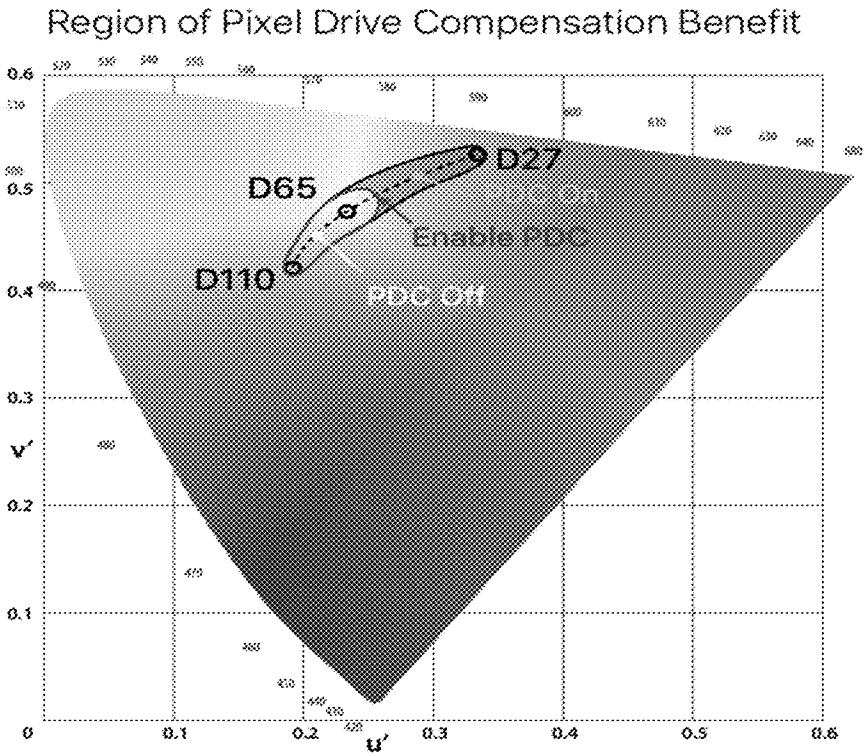
FIG. 6 depicts the range of display white points in u'v' space, showing optimal regions to enable pixel drive compensation.

Turning to FIG. 6, the term "white point" is the measurement of "white" on a color monitor. White point is expressed in degrees Kelvin or as one of the standard illuminants or in X-Y coordinates from a chromacity diagram. The most neutral white point is 6500 degrees Kelvin (6500° K), also referred to as "D65."

FIG. 6 plots the range of display white points in u'v' space, showing optimal regions to enable pixel drive compensation, in accordance with an embodiment of the present disclosure. From observation, the front of screen conditions that provide the most noticeable improvement when pixel drive compensation is enabled are when the system white point has been moved away from D65. This is due to different max 8-bit grey levels between the red, green and blue channels. For example, to put a display's white point at 2700° K (D27), the maximum of the red, green, and blue channels are set to 255, 186, and 94 in 8-bit space, respectively. At D65, the display will have all color channels set to 255 as the maximum. For white points less than D65, the blue and green will compensate to match the response time of the red channel.

Consequently, pixel drive compensation is useful when the display point deviates from D65. Embodiments may turn on pixel drive compensation in cases that the display white point drops below 5100° K (D51). In order to prevent a sudden toggling back-and-forth between enabling and disabling pixel drive compensation, a hysteresis may be used. As shown in FIG. 6, a hysteresis of 100° K centering around D65 is used. In practice, some embodiments may use a hysteresis of approximately between 50-150° K centering around D60-D70.

For liquid crystal display embodiments, it is suitable on the front of screen to turn on pixel drive compensation in cases that the display white point drops below 5100° K (D51). This observation may be panel dependent upon the liquid crystal response time. A more generalized threshold condition may be determined by measuring the color difference between sequentially displayed solid patterns at a particular white point and the same pattern with a black frame injected every third frame. FIGS. 7A and 7B illustrate an example sequential measurement of D27 white point where the duv' is found to be 0.0148 when pixel drive compensation is disabled and 0.004 with pixel drive compensation is enabled, in accordance with an embodiment of the present disclosure. The human visual system is typically able to discern a color difference at approximate duv' levels of 0.004-0.005. Consequently, the objective white point thresholding condition can be set to enable pixel drive compensation when the color difference between the two solid pattern sequences is greater than a threshold color difference. In some embodiments, the duv' level of 0.005 may be used as the threshold to enable pixel drive compensation. In other embodiments, the duv' level of 0.004 may be used as the threshold to enable pixel drive compensation. In yet other embodiments, the duv' level of 0.006 may be used as the threshold to enable pixel drive compensation. FIG. 8 shows typical white point to sRGB conversions as an example of the solid pattern white point conditions tested, in accordance with an embodiment of the present disclosure.

For organic light emitting diode (OLED) displays, pixel drive compensation power savings is from two aspects: 1. restricted usage below a given luminance threshold, and 2. limited usage on higher frame rate content. During low luminance conditions the jelly effect artifacts are especially prominent, so pixel drive compensation is especially helpful in addressing the image problem under those conditions. Some OLED display embodiments restrict power drive compensation based on a luminance threshold of <120 nits. Additionally, limiting pixel drive compensation for only higher frame rate content keeps overdrive on where it has maximum benefit and also saves about 50% power. Some OLED display embodiments restrict pixel drive compensation to whenever the frame rate exceeds 60 frames per second or higher. Other display embodiments restrict pixel drive compensation to whenever the frame rate content exceeds 30 frames per second or higher.

It is understood that when pixel drive compensation is not being performed, the pixel drive compensator (1000, 2000, 3000) outputs a received frame to the display panel (1200, 2200, 3200) that is not compensated.

It is understood by those familiar with the art that the system described herein may be implemented in a variety of hardware or firmware solutions.

The previous description of the embodiments is provided to enable any person skilled in the art to practice the disclosure. The various modifications to these embodiments will be readily apparent to those skilled in the art, and the generic principles defined herein may be applied to other embodiments without the use of inventive faculty. Thus, the present disclosure is not intended to be limited to the embodiments shown herein, but is to be accorded the widest scope consistent with the principles and novel features disclosed herein.

What is claimed is:

1. An apparatus comprising:

a display panel with a temperature sensor embedded in the display panel;

a pixel drive compensator configured to receive a received image frame and output a compensated output frame to the display panel, the received image frame being comprised of a plurality of pixels, the pixel drive compensator further comprising:

a memory configured to store a thin compensated look up table and a thick compensated look up table, the thin and the thick compensated look up tables containing grey-to-grey overdrive values for a given temperatures T1 and T2;

a previous frame buffer configured to store a previous frame;

a second previous frame buffer configured to store a second previous frame;

a duration mask configured to compare a given pixel from the received image frame, the previous frame, and the second previous frame to determine whether the thin compensation table or the thick compensated table should be used;

an interpolator configured to retrieve a temperature (T) associated the display panel, where T1<T<T2, to interpolate an overdrive value for a pixel from the image frame using the compensated lookup tables determined by the duration mask, and to generate the compensated output frame using the overdrive value for the associated pixel;

and, the display panel is further configured to display the compensated output frame.

2. The apparatus of claim 1 wherein the temperature compensated look up table is a two-dimensional matrix with a first dimension being a starting grey-level and a second dimension being an ending grey-level.

3. The apparatus of claim 2 wherein the two-dimensional matrix of the temperature compensated look up table contains a plurality of cells with the preset overdrive value.

4. The apparatus of claim 3 wherein the temperature compensated look up table compensates over a 0-60° C. temperature range.

5. The apparatus of claim 3 wherein the temperature compensated look up table compensates over a 10-50° C. temperature range.

6. The apparatus of claim 5 wherein the display panel is a liquid crystal display panel, an organic light emitting diode display panel, or a micro light emitting diode display.

7. The apparatus of claim 6 wherein the apparatus is a tablet computer, mobile phone, augmented reality display, notebook computer, computer display, or digital watch.

8. A method comprising:

storing a previous frame in a previous frame buffer;

storing a second previous frame in a second previous frame buffer;

receiving an image frame, the received image frame being comprised of a plurality of pixels;

storing a thin compensated look up table and a thick compensated look up table in a memory, the thin and the thick compensated look up tables containing grey-to-grey overdrive values for a given temperatures T1 and T2;

comparing, with a processor, a given pixel from the received image frame, the previous frame, and the second previous frame to determine whether the thin compensation table or the thick compensated table should be used;

retrieving a temperature (T) associated with the display panel, where T1<T<T2;

interpolating, with a processor, an overdrive value for a pixel from the image frame using the compensated lookup tables determined by a duration mask;

generating the compensated output frame using the overdrive value for the associated pixel;

displaying the compensated output frame on the display panel.

9. The method of claim 8 wherein the temperature compensated look up table is a two-dimensional matrix with a first dimension being a starting grey-level and a second dimension being an ending grey-level.

10. The method of claim 9 wherein the two-dimensional matrix of the temperature compensated look up table contains a plurality of cells with the preset overdrive value.

11. The method of claim 10 wherein the temperature compensated look up table compensates over a 0-60° C. temperature range.

12. The method of claim 10 wherein the temperature compensated look up table compensates over a 10-50° C. temperature range.

13. The method of claim 12 wherein the display panel is a liquid crystal display panel, an organic light emitting diode display panel, or a micro light emitting diode display.

14. A non-transitory computer-readable storage medium encoded with data and instruction, when executed by a microprocessor causes an apparatus to:

store a previous frame in a previous frame buffer;

store a second previous frame in a second previous frame buffer;

receive an image frame, the received image frame being comprised of a plurality of pixels;

store a thin compensated look up table and a thick compensated look up table in a memory, the thin and the thick compensated look up tables containing grey-to-grey overdrive values for a given temperatures T1 and T2;

compare, with a processor, a given pixel from the received image frame, the previous frame, and the second previous frame to determine whether the thin compensation table or the thick compensated table should be used;

retrieve a temperature (T) associated with the display panel, where T1<T<T2;

interpolate, with a processor, an overdrive value for a pixel from the image frame using the compensated lookup tables determined by a duration mask;

generate the compensated output frame using the overdrive value for the associated pixel;

display the compensated output frame on the display panel.

15. The non-transitory computer-readable storage medium of claim 14 wherein the temperature compensated look up table is a two-dimensional matrix with a first dimension being a starting grey-level and a second dimension being an ending grey-level.

16. The non-transitory computer-readable storage medium of claim 14 wherein the two-dimensional matrix of the temperature compensated look up table contains a plurality of cells with the preset overdrive value.

17. The non-transitory computer-readable storage medium of claim 16 wherein the display panel is a liquid crystal display panel, an organic light emitting diode display panel, or a micro light emitting diode display.

18. The non-transitory computer-readable storage medium of claim 17 wherein the apparatus is a tablet computer, mobile phone, augmented reality display, notebook computer, computer display, or digital watch.

19. The non-transitory computer-readable storage medium of claim 14 wherein the temperature compensated look up table compensates over a 0-60° C. temperature range.

20. The non-transitory computer-readable storage medium of claim 14 wherein the temperature compensated look up table compensates over a 10-50° C. temperature range.

* * * * *